US008490561B2

(12) United States Patent
Eveleigh

(10) Patent No.: US 8,490,561 B2
(45) Date of Patent: Jul. 23, 2013

(54) HULL SAFETY AND PROTECTIVE DEVICE

(75) Inventor: Robert B. Eveleigh, Naples, FL (US)

(73) Assignee: Magarl, LLC, Naples, FL (US)

( * ) Notice: Subject to any disclaimer, the term of this patent is extended or adjusted under 35 U.S.C. 154(b) by 94 days.

(21) Appl. No.: 12/856,137

(22) Filed: Aug. 13, 2010

(65) Prior Publication Data

US 2011/0036285 A1 Feb. 17, 2011

Related U.S. Application Data

(60) Provisional application No. 61/233,691, filed on Aug. 13, 2009, provisional application No. 61/326,916, filed on Apr. 22, 2010.

(51) Int. Cl.
*B63B 59/02* (2006.01)

(52) U.S. Cl.
USPC ..... 114/219; 114/343; 114/361

(58) Field of Classification Search
USPC ..... 114/219, 343, 361, 362
See application file for complete search history.

(56) References Cited

U.S. PATENT DOCUMENTS

| | | | | |
|---|---|---|---|---|
| 665,240 | A | 1/1901 | Livonius | |
| 1,220,876 | A | 3/1917 | Moore | |
| 1,383,551 | A | 7/1921 | Lowndes | |
| 3,216,030 | A | 11/1965 | Garfield | |
| 3,571,819 | A | 3/1971 | Puncochar | |
| 3,677,539 | A | 7/1972 | Bennet | |
| 3,693,573 | A | 9/1972 | Murphy | |
| 3,962,740 | A | 6/1976 | White | |
| 4,003,099 | A | 1/1977 | Hivko | |
| 4,337,716 | A | 7/1982 | Harris | |
| 4,721,487 | A | 1/1988 | Cochran | |
| 4,815,412 | A * | 3/1989 | Cassaro, Jr. | 114/343 |
| 4,962,719 | A * | 10/1990 | Hughes et al. | 114/343 |
| 4,986,785 | A | 1/1991 | Flowers | |
| 5,215,031 | A | 6/1993 | Inman et al. | |
| 5,257,592 | A | 11/1993 | Schaefer | |
| 5,357,890 | A * | 10/1994 | Mason et al. | 114/219 |
| 5,890,448 | A * | 4/1999 | Berresford | 114/219 |
| 5,899,166 | A * | 5/1999 | Alexander et al. | 114/361 |
| 6,612,256 | B1 | 9/2003 | Martin | |
| 6,722,307 | B1 * | 4/2004 | Rogers | 114/362 |
| 7,364,486 | B2 | 4/2008 | Serpa | |
| 2004/0112271 | A1 * | 6/2004 | Tucker | 114/361 |

FOREIGN PATENT DOCUMENTS

| | | |
|---|---|---|
| EP | 0438032 | 7/1991 |
| WO | 8704320 | 7/1987 |
| WO | 8803495 | 5/1988 |
| WO | 2009036494 | 3/2009 |

* cited by examiner

*Primary Examiner* — Lars A Olson
(74) *Attorney, Agent, or Firm* — John V. Daniluck; Bingham Greenebaum Doll LLP

(57) ABSTRACT

Apparatus and methods for attaching a safety device to the hull of a boat. In one embodiment, the safety device is a net that is held tightly in tension against the hull. The net is attached to the boat while it is in the water, and if the weather or sea state is threatening. If the boat capsizes, there will be sufficient tightness of the net against the hull such that the arms of an unconscious person can be placed through the netting, and the person will be kept safely above the water line. In yet other embodiments, a sheathing is attached to the hull that is a substantially continuous cover. The cover is attached to the boat prior to beaching the boat and protects the hull against abrasion by sharp objects.

28 Claims, 10 Drawing Sheets

HULL SAFETY AND PROTECTIVE DEVICE

CROSS REFERENCE TO RELATED APPLICATION

This application claims the benefit of priority to U.S. Provisional Patent Application Ser. No. 61/233,691, filed Aug. 13, 2009, entitled BOAT SAFETY NET, and Provisional Patent Application Ser. No. 61/326,916, filed Apr. 22, 2010, entitled HULL PROTECTIVE DEVICE, both of which are incorporated herein by reference.

FIELD OF THE INVENTION

Various embodiments of the present invention pertain to a net or sheath for marine use, and in particular some embodiments relate to safety and protective devices for a boat.

BACKGROUND OF THE INVENTION

There is continuing need for safety devices in the marine environment. A need for a new type of safety device was shown in the tragedy that occurred in early March 2009 in which four NFL players were put into the Gulf of Mexico after their boat capsized. Only one of the players survived.

Although their boat was capsized, the hull of the boat remained floating above the waterline. However, it is difficult to maintain a grip on a boat hull, which is typically a smooth, arching surface. In addition, even if a person were able to maintain a hold on the hull, the person would have to be conscious and have reasonable strength to do so. If the person became unconscious, there is no easy way to attach or lash them to the boat hull. Further, if the person becomes weak, he can lose his grip.

Various embodiments of the present invention provide an improved safety device for a capsized boat. Yet other embodiments pertain to a method of protecting a boat hull when beached.

SUMMARY OF THE INVENTION

One aspect of the present invention pertains to an apparatus for attaching a net to a boat. Some embodiments include a floatation device having a length, and a flexible handle attached to the device. Still other embodiments include a plurality of springs, each being spaced apart along the length. Some embodiments include a plurality of finger-operable clasps, each clasp being attached to one of the springs.

Another aspect of the present invention pertains to a method for attaching a device on the hull of a boat, such as a flexible sheath. Yet other embodiments include attaching a first portion of the sheath to a first location on one side of the bow of the boat, and attaching a second portion of the sheath spaced apart from the first portion to a second location on the other side of the bow of the boat. Some embodiments include placing the unattached portions of the sheath into the water in front of the bow and attaching the sheath to a third location on a side of the boat at a longitudinal position intermediate of the bow and stern. Still other embodiments include attaching a fourth portion of the sheath to a fourth location on the side of the boat, and tensioning the attached sheath against the hull of the boat.

Yet another aspect of the present invention pertains to an apparatus for attachment over the hull of a boat. Some embodiments include a flexible sheath having a length shorter than the length of the boat. Other embodiments include a pair of floatation devices, each device attached to the sheath proximate to one of the ends. Still other embodiments include a line attached to at least one of the floatation devices for pulling the floatation device in the water and a handle attached to each said device. The sheath tightly covers a portion of the hull of the boat. The other end of said sheath is attached to the boat proximate the bow, and each handle is attached to the boat on opposing sides of the boat intermediate of the bow and the stern.

It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

DESCRIPTION OF THE PREFERRED EMBODIMENT

Figure 1:
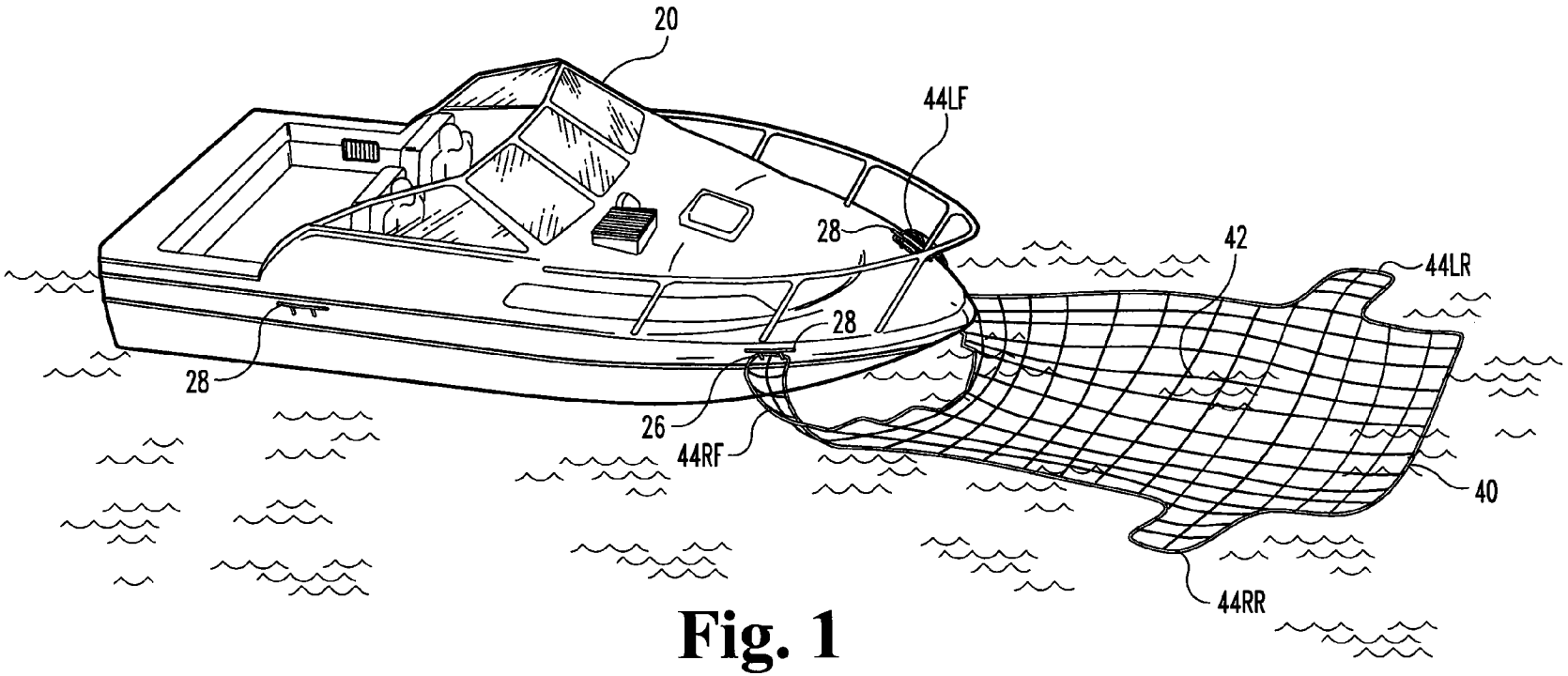
FIG. 1 is a top and right side perspective view of an apparatus according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. At least one embodiment of the present invention will be described and shown, and this application may show and/or describe other embodiments of the present invention. It is understood that any reference to "the invention" is a reference to an embodiment of a family of inventions, with no single embodiment including an apparatus, process, or composition that should be included in all embodiments, unless otherwise stated.

The use of an N-series prefix for an element number (NXX.XX) refers to an element that is the same as the non-prefixed element (XX.XX), except as shown and described thereafter. As an example, an element 1020.1 would be the same as element 20.1, except for those different features of element 1020.1 shown and described. Further, common elements and common features of related elements are drawn in the same manner in different figures, and/or use the same symbology in different figures. As such, it is not necessary to describe the features of 1020.1 and 20.1 that are the same, since these common features are apparent to a person of ordinary skill in the related field of technology. Although various specific quantities (spatial dimensions, temperatures, pressures, times, force, resistance, current, voltage, concentrations, wavelengths, frequencies, heat transfer coefficients, dimensionless parameters, etc.) may be stated herein, such specific quantities are presented as examples only, and further, unless otherwise noted, are approximate values, and should be considered as if the word "about" prefaced each quantity. Further, with discussion pertaining to a specific composition of matter, that description is by example only, and does not limit the applicability of other species of that composition, nor does it limit the applicability of other compositions unrelated to the cited composition.

Various embodiments of the present invention pertain to a net that is used as a safety device. In one embodiment, the net is attached to the boat and extends tightly against the underside of the hull of the boat. Should the boat capsize, the netting is available to hold in safety the former occupants of the boat.

In some embodiments, the netting is adapted and configured to first be attached to the boat at one or two locations. The user of the boat can then slowly motor the boat over the net. As the net sits under the hull of the boat, one or two other locations of the netting can be attached to other portions of the boat. The netting is preferably stretched tightly by applying tension at the boat attachment points. The tensioned netting preferably conforms closely to the shape of the hull.

In some applications, the netting is stretched across the hull of the boat. This can be accomplished by having one or more elastic features in the netting or in the attachment of the netting to boat, or a tensioning device in the boat itself (such as a hand-operated winch). In these applications, the netting is pulled tightly enough to be able to constrain a limb of a user within the netting if the boat has capsized.

In yet other embodiments, the netting includes a plurality of attachment ears. These attachment ears are connected to the boat above the water line. In one embodiment, the ears that attach to the rear of the boat include a sinking weight and a bobber. The sinker is attached at the outermost portion of the ear, and has sufficient weight to cause the outermost portion of the ear to sink. A bobber is placed inwardly from the location of the sinker, and has sufficient buoyancy to cause the innermost part of the ear to float. In this manner, the outer edges of the ears are projecting downwardly from the surface of the water.

Yet another embodiment of the present invention pertains to the use of a sheath as a safety or protective device when pulled tightly against a portion of the bow of a boat. Preferably, the sheath (whether a net or continuous covering) has a width that is sufficient to wrap around the hull at its widest point, and extending up to the gunwale or side of the boat. In yet other embodiments, the length of the sheath is sufficient to extend from the bow of the boat to a point forward of the boat's rudder and propulsion system, so as to not be entangled therein.

In yet another embodiment, the sunken portion of the ear includes a length of rope or cable attached proximate to the sinkers. In this way, as the boat is motored over the net, an occupant of the boat can pull the length of the rope and thereby pull the attachment ears toward the rear of the boat. This additional length of rope is also useful in those situations in which the boat cannot be driven over the net (such as due to a motor failure), and the net must be pulled by the occupants underneath the boat.

Yet other embodiments of the present invention pertain to a sheathing that can be attached to the boat so as to protect the hull. This sheathing is preferably fabricated from a smooth, tear-resistant material. The sheathing is attached to opposite sides of the boat, and pulled tightly against the hull. The sheathing protects the bottom of the boat if the boat is beached.

Yet another embodiment of the present invention pertains to a device for attaching a net or sheath to a boat. In some embodiments, the attachment device includes a plurality of tensioning springs that can be easily detached and reattached to the netting or sheathing. For instance, as a person uses one hand to pull the netting tight against the hull, the person can use his free hand can manipulate a clasp to unhook a spring from the netting and reattach it at a different position so as to provide tautness in the netting.

In yet another embodiment, there is an attachment device for tightly tensioning a netting or sheathing against the hull of a boat. The attachment device includes a flexible, resilient handle that can be used both to pull the device and the attached netting out of the water, and further can be wrapped around a portion of the boat such as a cleat. The handle is fabricated from an elastic material that can maintain a state of tension over a prolonged period of time.

In yet other embodiments, the attachment device includes a floatation device to which various springs and a handle are attached. The floatation device has a soft, conforming surface that will not abrade the side of the boat. In some embodiments, the device is fabricated from material that qualifies the device as a Class III personal floatation device. In such embodiments, the attachment device can be detached from the net, and used by an individual to maintain buoyancy in the water. In such embodiments the handle is adapted and configured to be placed around the arm or leg of a person.

Figure 2:
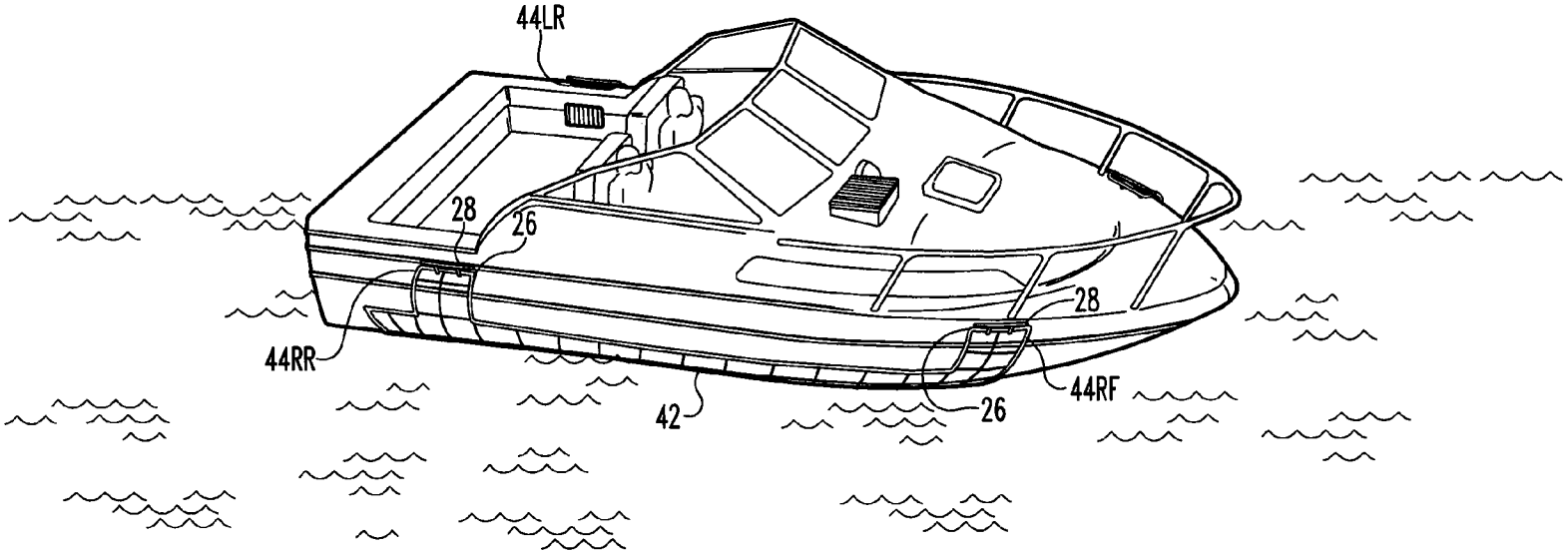
FIG. 2 shows the apparatus of FIG. 1 installed.
Figure 3:
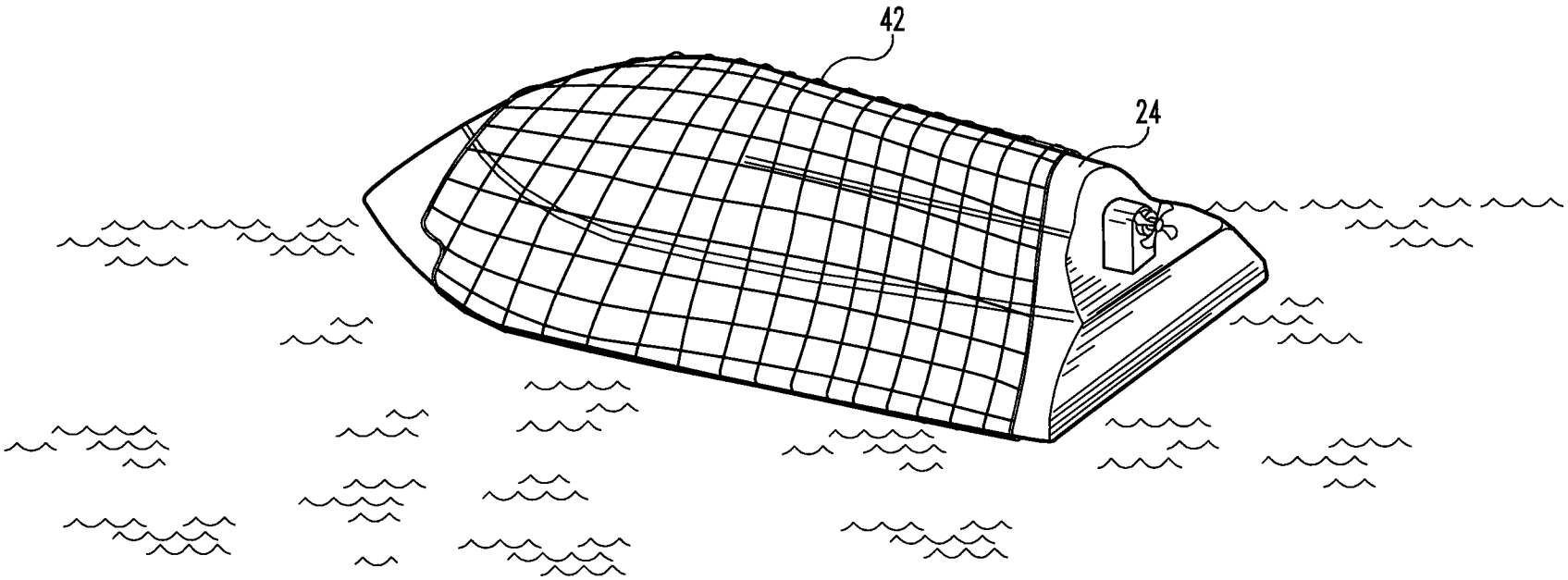
FIG. 3 shows the apparatus of FIG. 2 after the boat has capsized.

FIGS. 1-3 depict an apparatus according to one embodiment of the present invention. A boat 20 has attached to it a net assembly 40. Net assembly 40 includes a central netting portion 42 with a plurality of ears 44 placed around the periphery. A pair of ears 44 LF and 44 RF are attached at the left front and right front, respectively, to attachments 26 of boat 20. In one embodiment, ears 44 LF and 44 RF are extensions of central portion 42 and can also include localized reinforced areas for attachment, such as to a typical cleat 28. However, the various embodiments of the present invention are not constrained to attachment to a cleat, and can include attachment ears that can be coupled to the hand railing of the boat, or to other connection points within the boat, as examples.

Central portion 42 of netting 40 extends generally in front of boat 20. The net can be thrown forward by the occupants of the boat after first attaching the ears 44 LF and 44 RF to the front of the boat. The front central edge of net 40 is located generally under the forwardmost part of the bow of the boat. Ears 44 LF and 44 RF are each twisted 180 degrees relative to the central portion when it extends forward of the bow.

As best seen in FIG. 2, boat 20 can be motored over the central portion 42 of net 40 such that ears 44 LR and 44 RR can be attached at the rear cleats 28 of boat 20 on the left and right sides, respectively. Once all four ears are attached to boat 20, the ears are preferably pulled snug so as to apply tension throughout the central portion 42 of net 40. In some embodiments, this tension can be applied by simply removing an ear from its corresponding cleat, pulling on the ear, and reattaching it to the cleat at a different location within the ear.

The present invention contemplates any manner of tightening net 40 against the hull 24 of boat 20, including the use of any hand-operated winches or elastic rubber connections.

FIG. 3 depicts boat 20 after it has capsized. Most of central portion 42 of netting 40 extends in a tight pattern over hull 24. The netting provides an easy apparatus by which a former occupant of the boat can hold onto the boat without the need to tread water. Further, in those embodiments in which net 42 is held tightly against bow 24, a person can couple themselves to the capsized boat (or couple another person to the boat) by placing an arm or other limb through one of the openings in the net. The tight arrangement of the net against the hull will make it difficult for the limb to be removed. Such coupling could be used with an unconscious or weak person.

Figure 4:
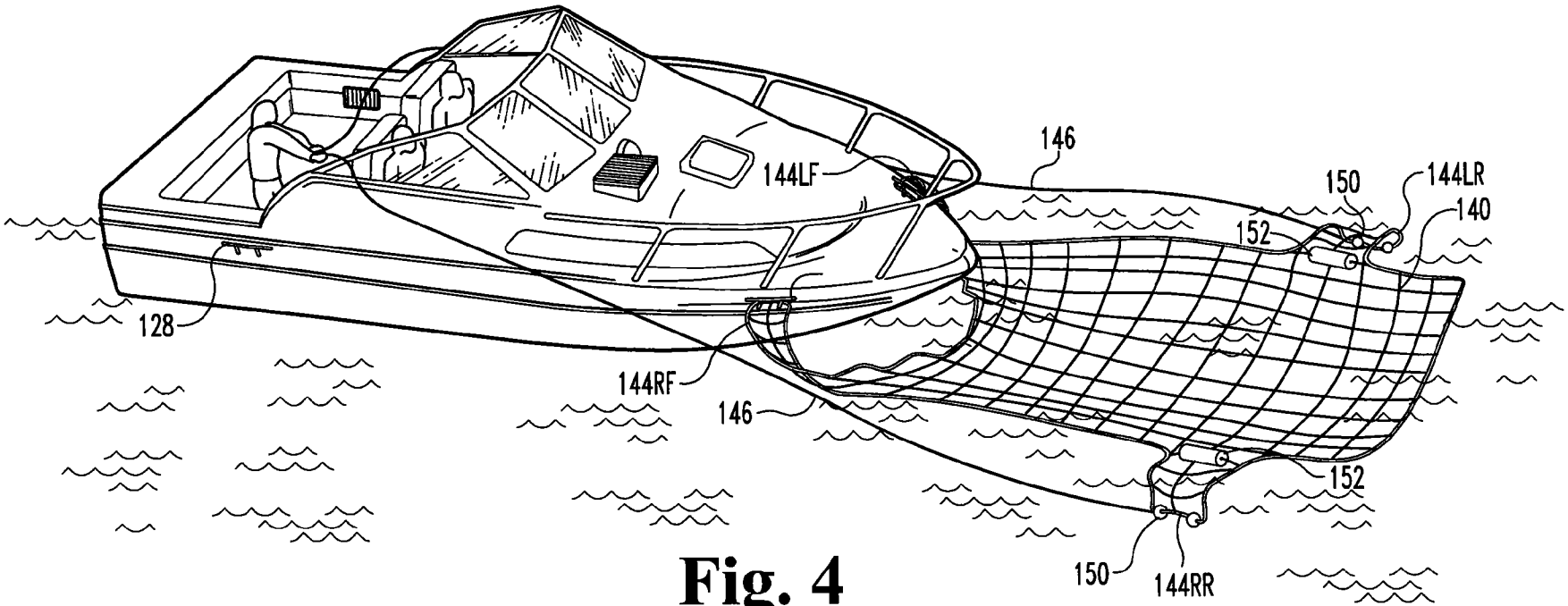
FIG. 4 is a top, right side perspective view of an apparatus according to another embodiment of the present invention.

FIG. 4 shows another embodiment of the present invention. Net assembly 140 is similar to net assembly 40, except that net assembly 40 includes features adapted and configured for attaching the net to the boat. Net assembly 140 includes ears 144 LR and 144 RR that include one or more sinkers 150 preferably attached to the outermost portion of the ear. Also connected to the outermost portion of the ear is one end of a length of rope or cable 146 that extends back to an occupant on boat 20. The innermost portion of ears 144 LR and 144 RR each include a bobber 152 that has sufficient buoyancy to overcome the weight of sinkers 150.

FIG. 4 shows a manner of attaching a safety net to a boat in which it is not necessary to motor the boat over the net. Sinkers 150 maintain a length of the corresponding ear pointed downward in the water. This orientation separates the attachment point of cable 146 from the central body 142 (the central body being buoyant). Bobbers 142 limit the sinking of the ear, and further provide visual indication of the location of the ears. As the occupant pulls cables 146 on either side of netting 140, the netting is pulled under and around the hull. Attachment of the ears 144 LR and 144 RR can now be made to the respective cleat 128.

Figure 5:
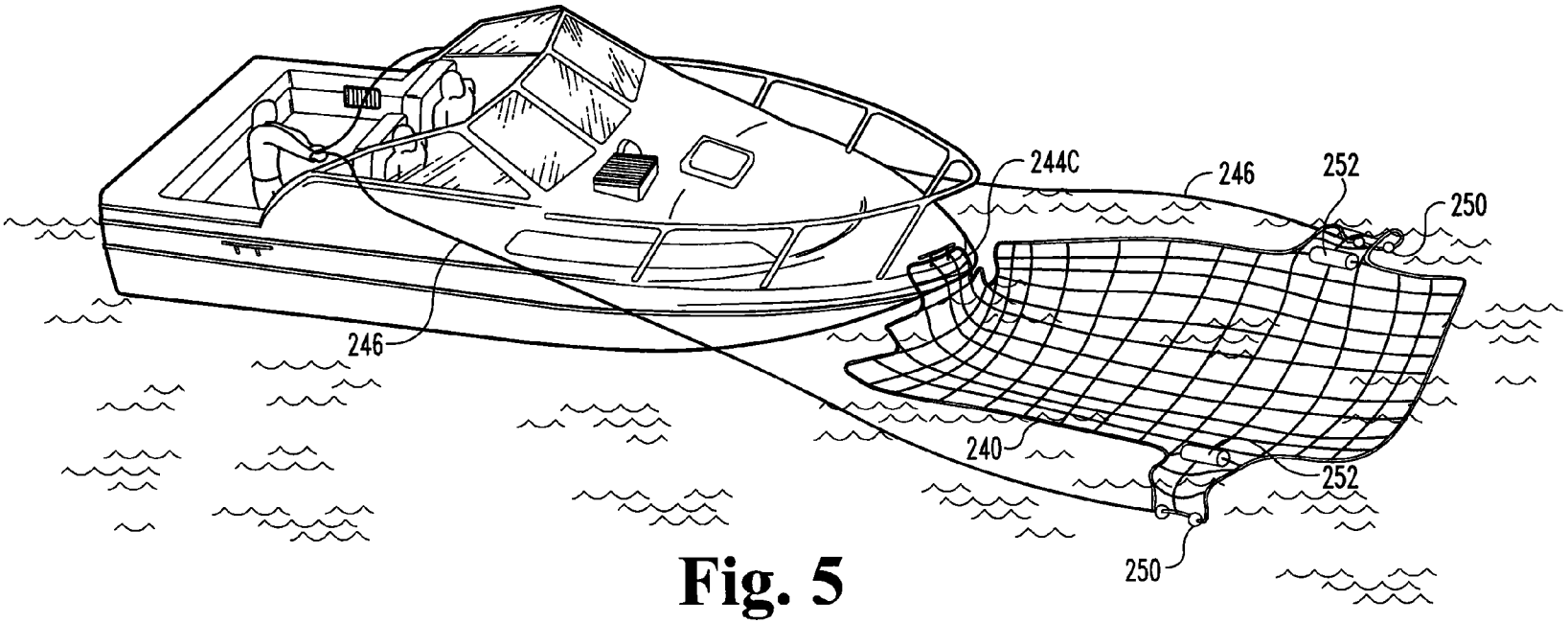
FIG. 5 is a top, right side perspective view of an apparatus according to another embodiment of the present invention.

FIG. 5 shows another embodiment of the present invention. Net 240 is similar to nets 40 and 140, except that net 240 includes a single attachment ear 244 C that is centered about body portion 242, and is preferably coupled to the tip of the bow of the boat.

Figure 6:
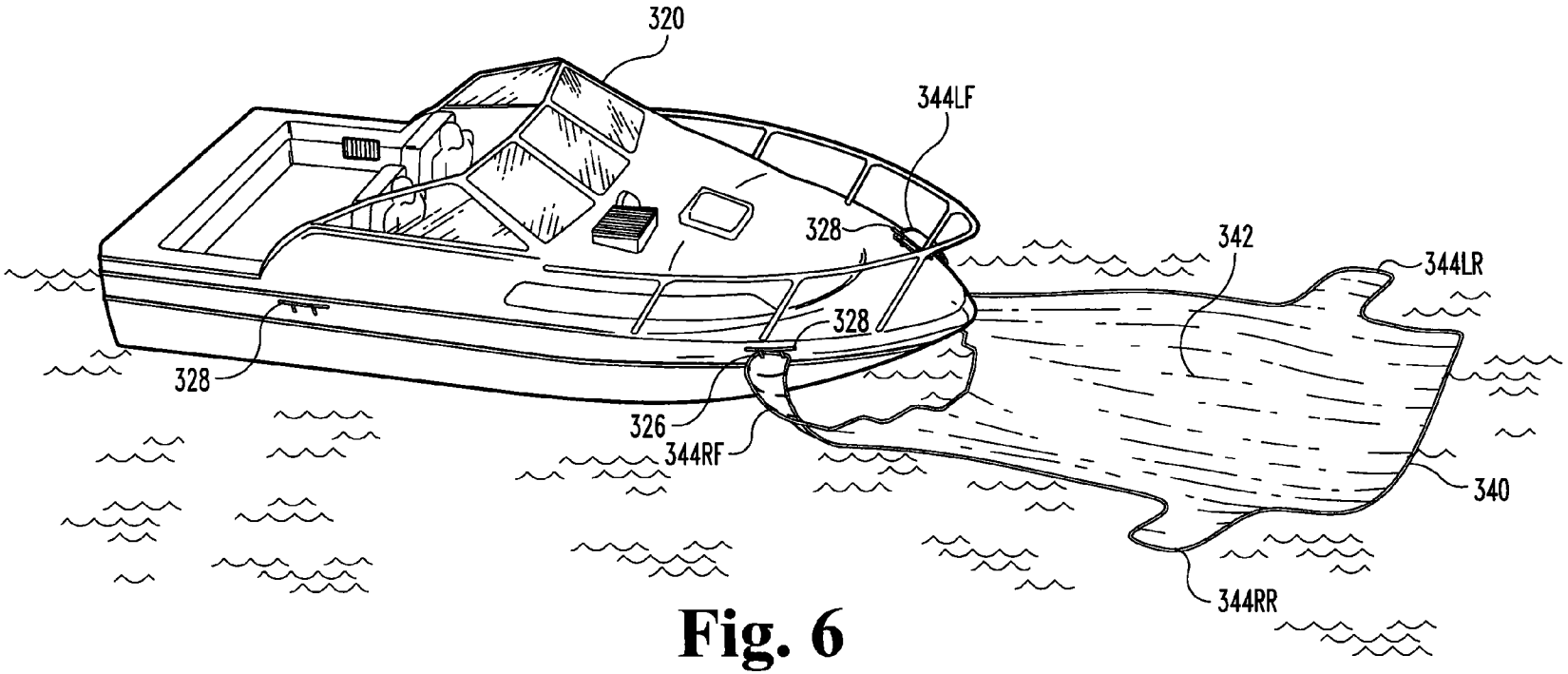
FIG. 6 is a top and right side perspective view of an apparatus according to another embodiment of the present invention.
Figure 7:
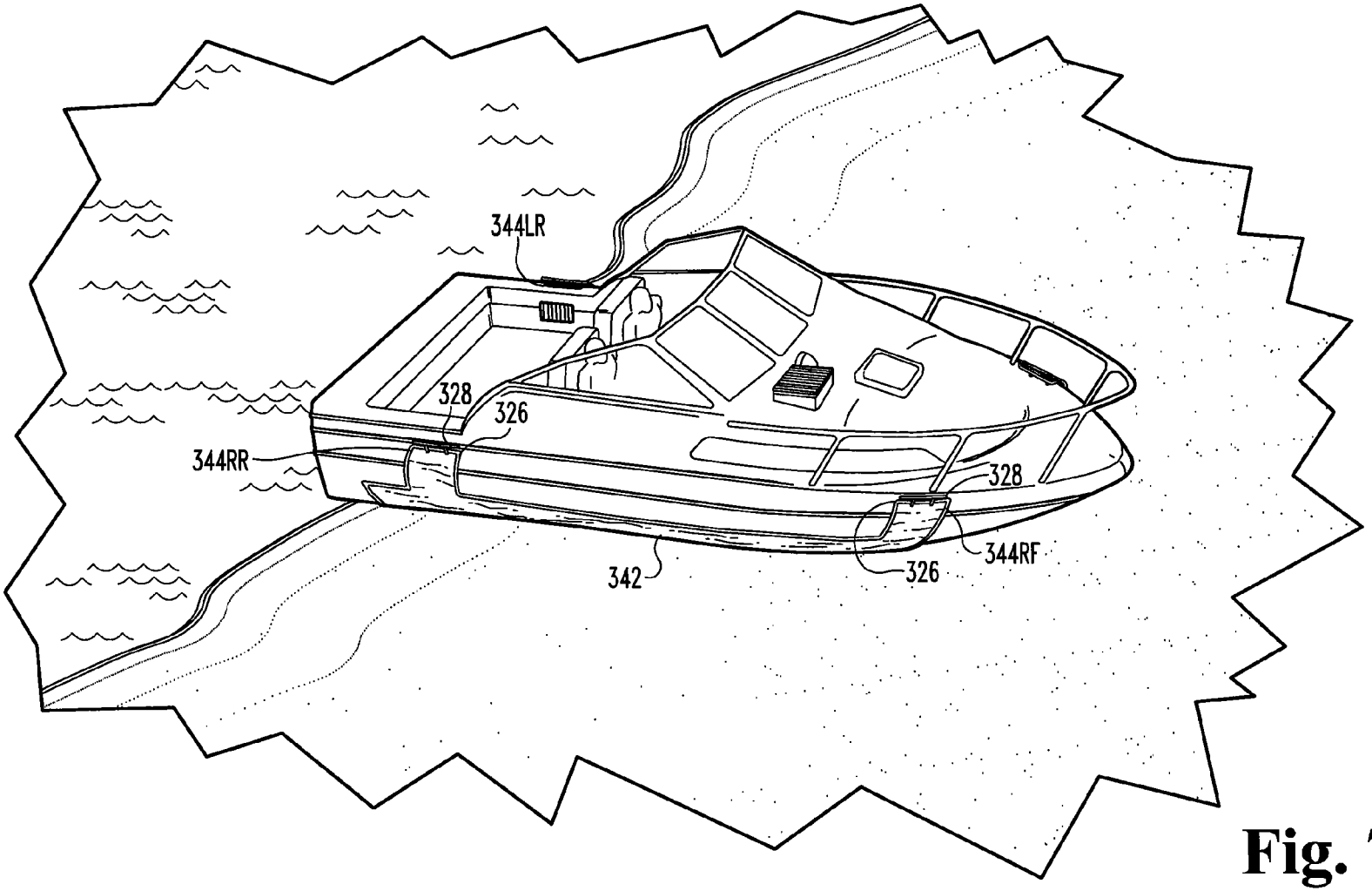
FIG. 7 shows the apparatus of FIG. 6 installed on a boat that has been beached.

FIGS. 6 and 7 show another embodiment of the present invention. A boat 320 has attached to it a sheath assembly 340. Sheath 340 includes a central sheathing portion 342 with a plurality of ears 344 placed around the periphery. A pair of ears 344 LF and 344 RF are attached at the left front and right front, respectively, to attachments 326 of boat 320. In one embodiment, ears 344 LF and 344 RF are extensions of central portion 342 and can also include localized reinforced areas for attachment, such as to a typical cleat 328. However, the various embodiments of the present invention are not constrained to attachment to a cleat, and can include attachment ears that can be coupled to the hand railing of the boat, or to other connection points within the boat, as examples.

Central portion 342 of sheathing 340 extends generally in front of boat 320. The sheath can be thrown forward by the occupants of the boat after first attaching the ears 344 LF and 344 RF to the front of the boat. The front central edge of sheath 340 is located generally under the forward most part of the bow of the boat. Ears 344 LF and 344 RF are each twisted 180 degrees relative to the central portion when it extends forward of the bow.

FIG. 7 shows a boat on which a sheath 340 has been attached. The boat has been beached on sand. Sheath 340 prevents the sand from abrading the bottom of the boat. In some embodiments, sheath 340 is fabricated from a synthetic material with good strength and abrasion resistance, such as Nylon® from DuPont. In some embodiments the sheath is reinforced at the edges with a filament (such as Nylon rope). Also, there can be a plurality of filaments extending in a reinforcing pattern (such as the pattern of net 40) either within or on one side of the sheath.

Figure 8:
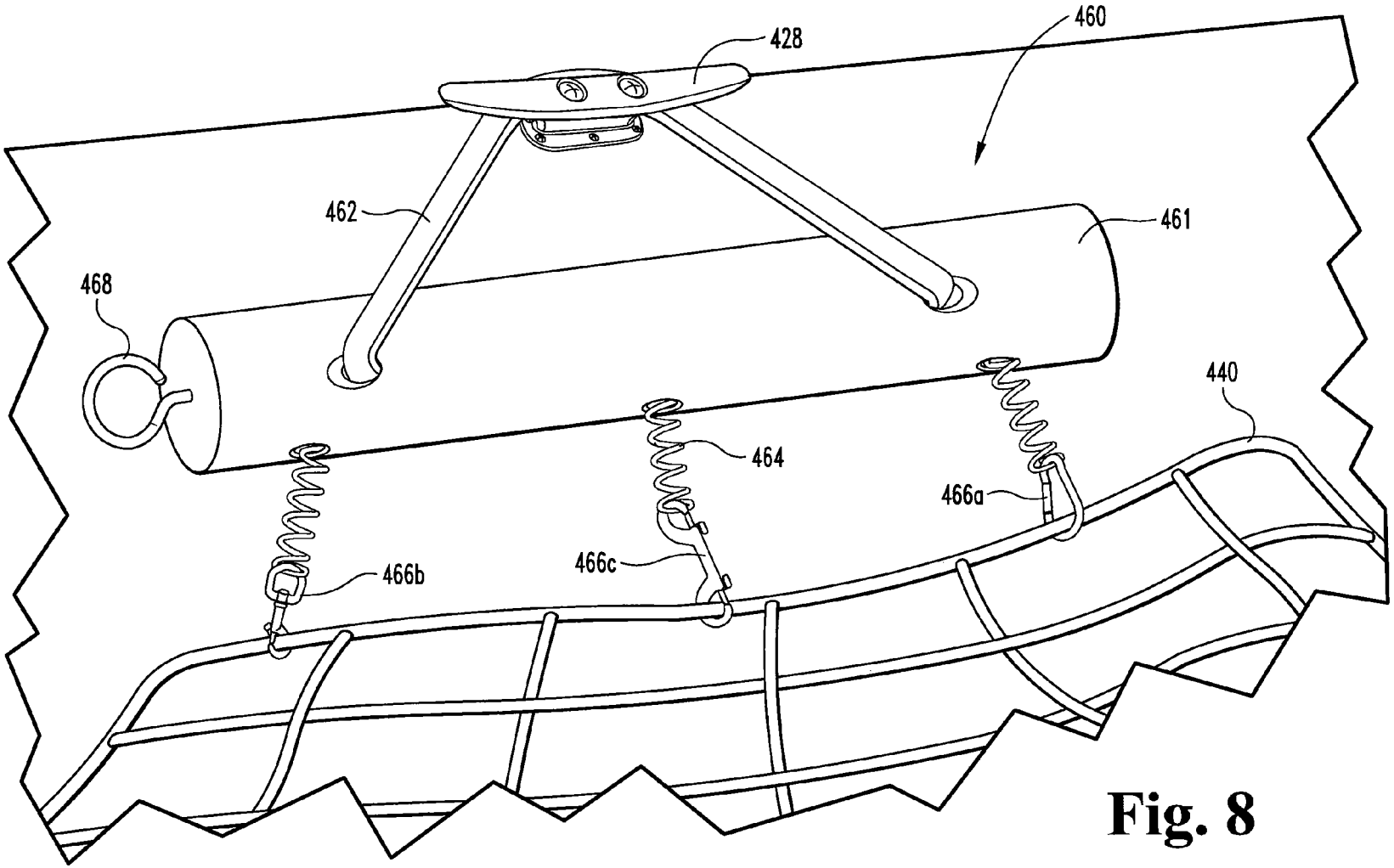
FIG. 8 shows a side, perspective view of a flotation and attachment device according to another embodiment of the present invention.

Although what has been shown and described is a sheath or net assembly 40 including a plurality of ears 44 for attaching the sheath 40 to the boat, yet other embodiments of the present invention contemplate alternative means of attachment to the boat. FIG. 8 shows an attachment device 460 according to one embodiment of the present invention. Attachment device 460 includes a generally cylindrical flotation device 461. In some embodiments, flotation device 461 is adapted and configured to comply with U.S. Coast Guard Class III requirements for a personal floatation device, and in yet other embodiments, floatation device 461 is configured to support sheath 440 from sinking, and further to provide a soft interface between sheath assembly 440 and the surface of the boat.

In one embodiment, floatation device 461 includes a handle 462 used both for pulling on sheath 440, and further for coupling of device 460 to a cleat 428. In some embodiments, handle 462 is a substantially flexible length of an elastomeric compound that can be stretched to extend around cleat 428, and further to maintain a state of tension. In yet other embodiments, handle 462 can include a handle portion of limited or no flexibility that is coupled to device 461 by a material or component capable of maintaining tension between the limited flexibility handle and device 461. In some embodiments, this attachment portion can be elastomeric straps, and in yet other embodiments this portion can be tensioning springs.

Further coupled to device 461 are a plurality of tensioning devices 464. These devices 464 couple at one end to device 461, and at the other end to sheath 440. In some embodiments, the tensioning devices 464 and the handle 462 have attachment points to the device 461 that are spaced apart from one another, so as to minimize the concentration of stress within the device 461. In the example as shown, device 461 is attached by three tensioning devices 464 that are equally spaced along the length of device 461. Handle 462 is attached to device 461 at points intermediate and in between the tensioning device attachment points.

As shown in FIG. 8, tension devices 464 are coil springs, preferably fabricated from a material such as stainless steel. As one example, each spring has a preload and spring constant adapted and configured to extend several inches upon application of a force in excess of about 20 pounds. However, it is understood that the size and load characteristics of the springs can be adjusted as required to account for the use of multiple springs, and for the strength characteristics of different types of individuals. Further, although what has been shown and described is a coiled tension spring, various embodiments of the present invention contemplate springs that are elastomeric straps, and springs of other configurations.

At the other end of each spring 464 is a finger-operable clasp 466 which couples spring 464 to a selected portion of sheath 440. Preferably, each clasp 466 is adapted and configured to be of a closed configuration, but openable by manipulation of the fingers and thumb of one hand. FIG. 7 shows a plurality of different types of clasps 466, although it is understood that this is by way of example only, and that it would be more typical to configure device 460 to have clasps of the same configuration.

Clasp 466*a* is a carabiner type of fitting, having a pivoting section that is biased to close an opening. Clasp 466*b* shows a D hook type of clasp, in which one end of the clasp is attached permanently to the spring, and the other end of the clasp includes a finger-operable sliding link that can be manipulated to open the clasping end. Clasp 466*c* is similar to that of 466*b*, except including finger operable sliding links at each end of the clasp assembly.

Although several different types of clasps have been shown and described, the present invention is not so constrained and yet other embodiments contemplate the use of any type of clasp in which one end is attachable to the spring and the other end can be readily and easily manipulated by one hand to be fastened or unfastened to the rungs of a net. Yet other embodiments of the present invention contemplate various means for releasably attaching (or snap attaching) the floatation device to the net, wherein the means includes, as examples, carabiners, snap hooks, pelican hooks, chain hooks, swivel snap shackles, swivel-eye boat snaps, swivel snaps, or any type of hook that is biased or snaps to a closed configuration, and including those that are permanently attached or swaged onto the end of the spring.

Further coupled to one end of device 461 is a hook 468. This hook in one embodiment is a substantially closed eyelet, to which a line such as nylon rope is connected. However, it is understood that in other embodiments of the present invention hook 468 can be coupled to an open hook on a long pole.

Device 460 can be used to attach any type of sheathing, whether open as a net or closed as a cover, to the hull of a boat. There is no need for the attachment ears 444 shown earlier, although some embodiments envision a combination of both a device 460 and an ear 444 to be used in conjunction.

In one embodiment of the present invention, a sheath 40 is attached on opposite sides of the boat and proximate to the bow. Preferably, the sheath 40 is taut between the two connection points, or at least does not contain excess, folded sheathing material. In some embodiments, a pair of attachment devices 460 are used to couple the sheath to the boat, although in other embodiments the sheathing or net can be attached directly to the boat, or attached to the boat in any manner.

After attachment of sheath 40 to the bow, the remainder of the net with a pair of floatation devices 60 attached to it is placed in the water in front of the boat. Each floatation device 61 is adapted and configured to float the weight of sheath 40. A line or a pole with a hook is attached to each hook 68 of device 60. A first device 60 is placed generally in front of the boat on one side, and the other attachment device 60 is located generally in front of the boat on the other side. One person pulls the line and device on the port side of the boat, underneath the hull, back to a longitudinal position intermediate of the bow and stern. Another person (or the same person, after first loosely attaching the first side), pulls the other line and attachment device 60 under the boat and toward a longitudinal position intermediate of the bow and stern on the starboard side of the boat.

After each device 60 is located in the water relatively close to the desired attachment point (such as a cleat), the device 60 is pulled out of the water and the handle is attached around the cleat. Although what has been shown and described is the attachment of a device 60 to a cleat by way of a flexible handle, it is further understood that other securement means can be used, including rigging lines.

After the first device is loosely attached to a cleat, the device on the opposite side of the boat is likewise pulled up, and the handle is attached to a cleat on that side of the boat. The sheath 40 can now be tightly tensioned against the hull. If the sheath 40 is not sufficiently tight, then the operator can pull upward on sheath 40, disconnect a clasp, and reconnect the clasp so as to maintain tension. The other clasps on that device can further be detached, the sheath pulled tight, and the clasps reattached. The process of tensioning, detaching, and reattaching can continue until sheath 40 is sufficiently tensioned against the hull.

Figure 9:
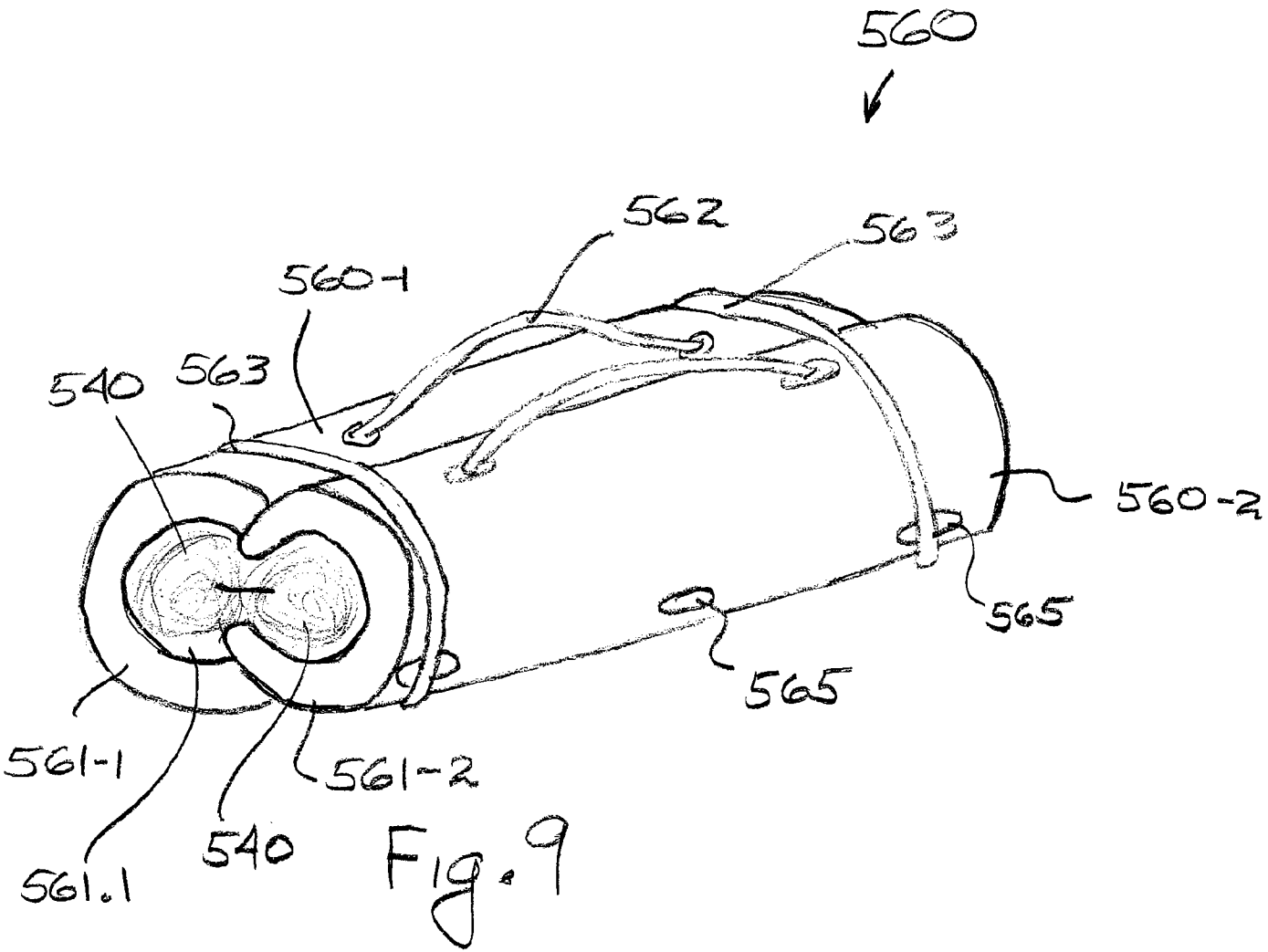
FIG. 9 is a side and frontal perspective view of a safety device according to another embodiment of the present invention.
Figure 10:
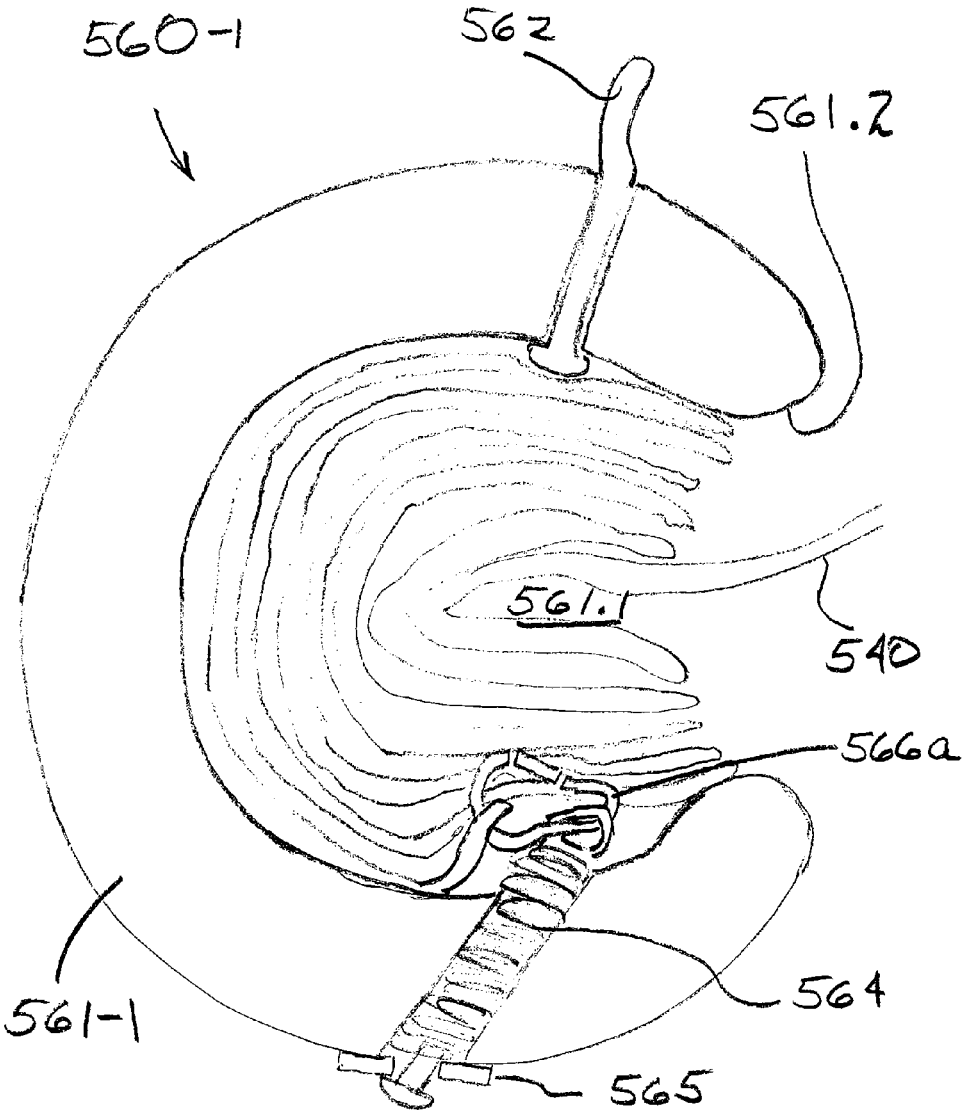
FIG. 10 is a modified cross-sectional view of a portion of the apparatus of FIG. 9.

FIGS. 9 and 10 show an attachment and safety assembly 560 that includes a pair of modified attachment devices 560-1 and 560-2 that each include a floatation device 561-1 and 561-2, respectively, with means for self-storing other components, such as netting 540, springs 564, and clasps 566.

FIG. 9 shows a pair of safety and attachment devices 560-1 and 560-2 that are coupled together in a parallel configuration by a pair of straps 563. Straps 563 are placed at either end of the assembly of the two attachment devices and firmly join them together. The handles 562 extend outwardly, and provide a convenient means for carrying the assembly.

As shown in FIG. 9, both handles 562 extend from the same side of the assembly. However, other embodiments of the present invention contemplate other locations for placement of the straps, including straps on opposite sides (right and left sides, as seen in FIG. 9), especially in those embodiments in which the opposite strap locations are preferable when using device 560 as a personal floatation device. Further, it is understood that the assembly 560 shown in FIG. 9 could further be protectively wrapped in a material, such as a clear shrink wrapping to keep dirt, water, and debris out of the interior of assembly 560 until it is time to use it. Still further, although the pair of devices are shown in a parallel configuration, it is understood that yet other embodiments contemplate two or more devices that are arranged in a co-linear fashion. The netting remains internal to the devices and extends from a rightmost end of the internal volume to the leftmost end of the internal volume. In addition, although FIG. 9 shows two devices 560 arranged side by side, yet other embodiments contemplate an arrangement of three or four devices arranged in parallel in a triangular or quadrilateral configuration, respectively. In such embodiments, it is preferable that the openings of the internal volume all be generally facing one another, to facilitate storage of the netting among them.

FIG. 10 is a cutaway view of the left side of device 560, showing a cutaway of attachment device 560-1. It is appreciated that the cutaway line jogs through a spring attachment location and a handle attachment location. FIG. 10 shows that floatation device 561-1 is fabricated from a generally rectangular piece of material that is placed into a C-shaped configuration. Preferably, the material of device 561-1 is generally soft and conformable to a surface, and preferably a material that retains a floatation quality, especially for certification as a Class III safety device. In some embodiments, the planned shape of device 561-1 is rectangular, and is able to expand back to a rectangular shape after release from straps 563. However, in yet other embodiments, the material of device 561-1 is formed into a C-shape, and retains that general shape even after release from straps 563. Yet other embodiments include a device 561-1 that is fabricated from a empty cylinder, with an arc of the cylinder removed for storage of the netting, or with a parting line introduced along one side to allow access to the interior.

Floatation device 561-1 as shown in FIG. 10 defines an internal volume 561.1. Referring back to FIG. 9, the ends 561.2 of the C-shape generally oppose each other in one direction, and further oppose in a different direction the ends of the C-shape of the device 561-2. Although what has been shown and described is a quantity of material that has been formed into a C-shape, yet other embodiments contemplate other configurations, including configurations that are substantially circular, such as where the ends of the C-shape are in contact. Further, yet other embodiments contemplate other cross-sectional shapes, including rounded triangular shapes and square shapes, as examples.

Safety netting 540 is folded and stored within the internal volume 561.1 of the stored device 560-1. In those embodiments in which multiple devices 560 are coupled to each other (such as in FIG. 9), about half of netting 540 is stored in the internal space of a first attachment device 560-1, and the remainder is stored in the internal volume of the other attachment device. FIG. 10 shows a portion of netting extending toward the right, where it would couple to the other half of the stored netting (not shown).

Again referring to FIG. 10, spring 564 can be stored within the thickness of the material of floatation device 561.1, and further since the netting 540 is readily conforming, a portion of spring 564 can also extend into internal volume 561.1. Netting 540 is shown stored and already attached by a clasp **566*a* to the end of spring 564. The other end of spring 564 is shown coupled to floatation device 561-1 by way of a mushroom head that extends beyond a washer or grommet 565**.

Assembly 560 is shown in FIG. 9 in a storage configuration, with a pair of straps 563 coupling together a pair of attachment devices 560 storing within them netting 540. This compact configuration is easily and neatly stored on the boat. Further, if necessary, device 560 can be thrown overboard as a single floatation device, with the swimmer holding on to one or both straps 562.

However, if the users of the boat sense threatening conditions, then the straps 563 (and shrink wrap) can be removed for deployment of the netting. After the two attachment devices 560-1 and 560-2 are separated, the netting extends between them, which further unfolds to reveal a forward portion for attachment to the bow. After the forward portion is attached to the bow (such as to cleats on the bow), the remainder of the netting and the two separated attachment devices are pulled back along the boat, such that netting 540 extends underneath the boat and over the hull. The handles 562 are subsequently coupled to the boat (such as to cleats located mid-ships), and the netting can be placed in tension as previously described. When the net is placed in tension, floatation device 561-1 opens to a flatter shape.

While the inventions have been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed:

1. An apparatus for attaching a net to a boat, comprising:

a floatation device having a length;

a flexible handle attached to said device, said handle being adapted and configured for attachment to a cleat;

a plurality of springs each having a pair of ends, one end of each said spring being attached to said device, each of said springs being spaced apart along the length; and a plurality of finger-operable clasps, each said clasp being attached to the other end of a corresponding one of said springs.

2. The apparatus of claim 1 wherein the clasp is a carabiner.

3. The apparatus of claim 1 wherein the clasp is slidably operable by a thumb of a user.

4. The apparatus of claim 1 wherein each said clasp is biased to a closed configuration, and movable to an opened configuration by finger manipulation.

5. The apparatus of claim 1 wherein said handle is attached to said device so as to pull substantially equally between said springs.

6. The apparatus of claim 1 wherein said handle is elastomeric.

7. The apparatus of claim 1 which further comprises a hook attached to said device, said hook being adapted and configured to connection to a rope.

8. The apparatus of claim 7 wherein the hook is a round substantially closed eyelet.

9. The apparatus of claim 1 which further comprises a net, wherein said floatation device defines an internal chamber, at least a portion of said net being stored within the chamber, said net being attached to at least one said clasp.

10. A method for attaching a device on the hull of a boat having a bow, a stern, and port and starboard sides, comprising:

providing a flexible sheath and a boat floating in water and having waterlines on the port and starboard sides;

attaching a first portion of the sheath to a first location on one side of the bow of the boat;

attaching a second portion of the sheath spaced apart from the first portion to a second location on the other side of the bow of the boat;

attaching a third portion of the sheath spaced apart from both of the first and second portions to a third location on a side of the boat at a longitudinal position intermediate of the bow and stern;

attaching a fourth portion of the sheath spaced apart from all of the first, second, and third portions to a fourth location on the side of the boat opposite of the third location at a longitudinal position intermediate of the bow and stern;

tensioning the attached sheath against the hull of the boat, such that one edge of the sheath extends out of the water and past the port water line, and another side of the sheath extends out of the water and past the starboard waterline;

wherein said tensioning is by pulling on springs.

11. The method of claim 10 wherein the sheath includes tensioning devices at one of the first or second locations and one of the third or fourth locations.

12. The method of claim 10 wherein the third portion includes a flexible line, and which further comprises pulling the line and locating the third portion prior to said attaching a third portion.

13. The method of claim 10 wherein the sheath is a net.

14. The method of claim 10 wherein the sheath is a substantially closed covering.

15. The method of claim 10 wherein said attaching a third portion to a third location is with a clasp device operable by a single hand, and said attaching a fourth portion to a fourth location is with a clasp device operable by a single hand.

16. The method of claim 15 wherein said tensioning is by biasing the clasp of the third portion toward the boat and biasing the clasp of the fourth portion toward the boat.

17. The method of claim 16 wherein said biasing the third portion is with a spring and said biasing the fourth portion is with a spring.

18. An apparatus for attachment over hull of a boat having a bow and a stern, comprising:

a flexible sheath having a length from end to end shorter than the length of the boat, and having a width from side to side;

a pair of floatation devices, each said device attached to said sheath proximate to one of the ends and spaced apart from one another;

a line attached to at least one said floatation device for pulling said floatation device in the water; and a handle attached to each said device, said handle being adapted and configured for attachment to the boat;

wherein said sheath is adapted and configured to tightly cover a portion of the hull of the boat, the other end of said sheath is adapted and configured to be attached to the boat proximate the bow, and each handle is adapted and configured to be attached to the boat on opposing sides of the boat at a position intermediate of the bow and the stern.

19. The apparatus of claim 18 wherein the sheath is a net.

20. The apparatus of claim 18 wherein the sheath is a substantially closed covering.

21. The apparatus of claim 18 which further comprises means for releasably attaching the device to the sheath.

22. The apparatus of claim 21 wherein said attachment means is a carabiner.

23. The apparatus of claim 21 wherein said attachment means includes a hook shape member and a biased movable member for closing the hook shape.

24. The apparatus of claim 21 wherein each said clasp is biased to a closed configuration, and movable to an opened configuration by finger manipulation.

25. The apparatus of claim 18 wherein each said handle is elastomeric.

26. The apparatus of claim 18 wherein each said handle is flexible.

27. The apparatus of claim 18 which further comprises a hook attached to said device for attachment of said line.

28. A method for attaching a device on the hull of a boat having a bow, a stern, and port and starboard sides, comprising:

providing a flexible sheath and a boat floating in water and having waterlines on the port and starboard sides;

attaching a first portion of the sheath to a first location on one side of the bow of the boat;

attaching a second portion of the sheath spaced apart from the first portion to a second location on the other side of the bow of the boat;

attaching a third portion of the sheath spaced apart from both of the first and second portions to a third location on a side of the boat at a longitudinal position intermediate of the bow and stern;

attaching a fourth portion of the sheath spaced apart from all of the first, second, and third portions to a fourth location on the side of the boat opposite of the third location at a longitudinal position intermediate of the bow and stern;

tensioning the attached sheath against the hull of the boat, such that one edge of the sheath extends out of the water and past the port water line, and another side of the sheath extends out of the water and past the starboard waterline;

wherein said attaching a third portion to a third location is with a clasp device operable by a single hand, and said attaching a fourth portion to a fourth location is with a clasp device operable by a single hand;

wherein said tensioning is by biasing the clasp of the third portion toward the boat and biasing the clasp of the fourth portion toward the boat; and wherein said biasing the third portion is with a spring and said biasing the fourth portion is with a spring.

* * * * *